United States Patent [19]

Oppenheim et al.

[11] Patent Number: 4,974,571

[45] Date of Patent: Dec. 4, 1990

[54] PULSED JET COMBUSTION GENERATOR FOR NON-PREMIXED CHARGE ENGINES

[75] Inventors: A. K. Oppenheim, Berkeley; H. E. Stewart, Alameda, both of Calif.

[73] Assignee: Regents of the University of California, Oakland, Calif.

[21] Appl. No.: 315,404

[22] Filed: Feb. 24, 1989

[51] Int. Cl.[5] ..... F02M 69/08; F02M 23/00

[52] U.S. Cl. ..... 123/531; 123/532; 123/1 A

[58] Field of Search ..... 123/1 A, 531, 532, 533, 123/534, 535

[56] References Cited

U.S. PATENT DOCUMENTS

| | | | |
|---|---|---|---|
| 3,013,732 | 12/1961 | Webster et al. . | |
| 3,283,502 | 11/1966 | Lefebvre . | |
| 3,474,970 | 10/1969 | Simmons et al. . | |
| 3,626,910 | 12/1971 | Porsche . | |
| 3,675,853 | 7/1972 | Lapera . | |
| 3,698,368 | 10/1972 | Yamamoto . | |
| 3,912,164 | 10/1975 | Lefebvre et al. . | |
| 3,980,233 | 9/1976 | Simmons et al. . | |
| 4,006,719 | 2/1977 | Kanda et al. | 123/531 X |
| 4,139,157 | 2/1979 | Simmons . | |
| 4,168,804 | 9/1979 | Hofmann | 239/533.11 |
| 4,223,698 | 9/1980 | Reinicke | 137/595 |
| 4,462,760 | 7/1984 | Sarich et al. | 417/54 |
| 4,519,356 | 5/1985 | Sarich | 123/533 |
| 4,561,405 | 12/1985 | Simons | 123/531 |
| 4,592,328 | 6/1986 | Firey | 123/531 |
| 4,595,143 | 6/1986 | Simmons et al. | 239/406 |
| 4,712,524 | 12/1987 | Smith et al. | 123/531 X |
| 4,753,213 | 6/1988 | Schlunke et al. | 123/533 |
| 4,782,809 | 11/1988 | Kotowski et al. | 123/531 |
| 4,798,190 | 1/1989 | Vaznaian et al. | 123/531 |

FOREIGN PATENT DOCUMENTS

| | | | |
|---|---|---|---|
| 0820420 | 11/1937 | France | 123/532 |

*Primary Examiner*—Willis R. Wolfe

*Attorney, Agent, or Firm*—Robert W. Mulcahy; Berthold J. Weis; L. E. Carnahan

[57] ABSTRACT

A device for introducing fuel into the head space of cylinder of non-premixed charge (diesel) engines is disclosed, which distributes fuel in atomized form in a plume, whose fluid dynamic properties are such that the compression heated air in the cylinder head space is entrained into the interior of the plume where it is mixed with and ignites the fuel in the plume interior, to thereby control combustion, particularly by use of a multiplicity of individually controllable devices per cylinder.

17 Claims, 7 Drawing Sheets

PULSED JET COMBUSTION GENERATOR FOR NON-PREMIXED CHARGE ENGINES

FIELD OF THE INVENTION

This invention generally relates to a method and apparatus for generating pulsed jets carrying atomized fluid reactants under conditions leading to the formation of turbulent plumes within which background gaseous reactants and atomized fluid reactants are intermixed and burned. More particularly, the invention relates to plume generators for non-premixed charge engines, more commonly referred to as diesel engines, wherein fuel is introduced into the piston compression heated air in the head space in the form of fine droplets contained in a carrier air stream under conditions leading to the formation of plumes.

The U.S. government has rights in this invention pursuant to Contract DE-AC03-76SF00098 between the U.S. Department of Energy and the University of California for the operation of Lawrence Berkeley Laboratory.

BACKGROUND OF THE INVENTION

The present invention is related to a copending patent application, Ser. No. 315,403 entitled "Method and System for Controlling Combustion in Internal Combustion Engines," by Antoni K. Oppenheim, now U.S. Pat. No. 4,924,828, whose disclosure is incorporated herein by reference. This application describes in detail how improved control over combustion can be achieved by causing the process of combustion to take place within certain distinct fluid dynamic structures formed by jets. Such fluid dynamic structures are called plumes.

Their characteristic feature is a relatively high level of rotation in the form of a sequence of more or less convoluted vortex rings as well as swirl (i.e. azimuthal rotation around the axis of the jet), which are fluid motions that induce entrainment or inhalation of the surrounding charge into their midst. Under such circumstances the process of combustion takes place primarily inside the plumes rather than on their boundaries. When the velocity of rotation is slowed down by momentum exchange associated with entrainment and expansion due to the exothermicity of combustion, the inhaling effects subside and the plume enters the stage of puff, i.e. a cloud of gaseous products of combustion, by now in an arrested state of rotation, which becomes enveloped by a flame front. The key to a successful operation of the invention is to maximize the action of the plume and minimize that of the puff. Towards this end, the progress of combustion in the engine is controlled by a timed, sequential injection of a plurality of jets forming plumes, so that the head space of the cylinder is progressively filled by their evolving structures. The head space is eventually entirely filled by adjacent plumes as they burn by combustion taking place in their interior before reaching the stage of a puff, thus denying the flame-fronts the usual dominating role in the propagation of the combustion process. The above cited application further explains in detail the underlying reasons for the advantages of causing combustion to take place within multiple plume structures wherein the formation and propagation of flame fronts at their boundaries is inhibited. Since the latter is the major reason for the development of combustion instabilities as well as the formation of pollutants and, especially, particulates (soot), these harmful effects are thereby obviated.

The principle of controlling combustion by resorting to plumes within which reactants are mixed and caused to react, is generally applicable to any known system of reactants in an internal combustion engine. The copending patent application, Ser. No. 315,405 entitled "Pulsed Jet Combustion Generator for Premixed Charge Engines" by Antoni K. Oppenheim, Horton E. Stewart, and Kenneth Hom, now U.S. Pat. No. 4,926,818, addresses an important subset of reactants and reaction conditions, i.e., the combustion of fuels such as more volatile hydrocarbons and/or alcohol in air, carried out in the compressed premixed charge of the so-called Otto type engine. In accordance with the above cited invention, spark ignition systems and the attendant flame propagation mode of combustion are replaced by multiple generators of jets of combustion products that form plumes which entrain the surrounding premixed reactants and upon ignition by contact with the products, burn them in their interior.

The present invention addresses another important subset of reactants and reaction conditions, i.e. diesel engines, in which liquid fuel is introduced into air which has been heated to such a degree so as to initiate combustion of the fuel. In conventional diesel engines the fuel is normally a higher chain length hydrocarbon of a lower volatility injected in liquid form into air heated by piston compression at a volumetric ratio of typically twenty to one. The present invention essentially replaces the conventional diesel injector mechanism by a plurality of plume forming jet generators. The plumes contain fuel in the form of very fine droplets within a carrier air jet streams, forming, upon injection into the compressed air, plumes that consist of a sequence of large scale, whirlpool type, eddy structures associated with rotation to entrain (inhale) the surrounding medium into their midst. In this case it is the hot piston compressed air which is entrained into the interior of the plume, causing it to get in contact and consequently react with the fuel carried in the interior of the plume by the colder airstream. It is important to note that by causing combustion to take place within the reacting plumes, whose magnitude and timing is determined by external action, it is possible to control combustion by adjusting external parameters so that it takes place under locally premixed conditions and thus subdue significantly the tendency to form particulates (soot) and develop combustion instabilities such as knock.

In practice, each cylinder would be outfitted with a plurality of such plume generators, permitting control over the combustion process by adjusting the quantities and sequential timing of the reactants introduced thereby into the head space. The mature size of each plume upon completion of its function of carrying out the combustion of the fuel occupies between about $\frac{1}{2}$ to $\frac{1}{8}$ the volume of the head space at top dead center. Each plume generator may also include means for introducing into said fuel metered quantities of fuel additives, which may be compounds for either accelerating or decelerating combination reactions.

THE PRIOR ART

In non-premixed charge engines, also known as diesel engines, fuel spray is injected into piston-compressed air at an appreciable inlet velocity. The spray consists of a multitude of fine droplets whose number density is high enough so that they are closer to each other than the stand-off distance of the flame. Under such circumstances, the flame front becomes established as a diffusion flame forming an envelope around the spray. More precisely, we mean a flame established at the interface between the fuels or a fuel carrying gas devoid of oxygen, and the oxidizer medium, such as air. Technically this is referred to as the group combustion mode of a spray. Once such a mode is established, oxygen is depleted inside the flame envelope, while fuel is consumed at the front so that practically none of it penetrates outside. As a consequence, the fuel reaches the maximum temperature it can achieve by combustion with air at the flame front, establishing conditions conducive to the formation of nitric oxide. Fuel approaching this high temperature zone in the absence of oxygen is also pyrolized, generating soot. Moreover, as a consequence of the relatively short residence time of the reacting medium in the then quite a narrow zone of essential chemical activity (i.e. the region of high concentration of active radicals serving as chain carriers) at the front, optimum conditions are established for the generation of carbon monoxide. In essence then, the group combustion mode process that takes place in conventional diesel engines generate automatically the most favorable conditions for producing all the well known pollutants.

To make matters worse, with the conventional system of a single injector per cylinder, in order to assure good contact of fuel with air, one has to rely on the momentum of the spray in order to drive the flame front across the compressed air charge. Created thus is the familiar noise of diesel engines and the tendency to knock, due to inordinate ignition delay, permitting an excessive amount of fuel to combust at the same time. Thus created is the demand for fuels of a relatively high cetane number, that is, fuels that burn at a relatively high rate to be commensurate with the rate at which they are injected into the combustion chamber.

It is known that sprays of atomized fuel can be formed by subjecting sheets or streams of liquid fuel to high shear forces of high pressure air flows. For example, U.S. Pat. No. 3,912,164, issued Oct. 14, 1975 to Lefebre et al, discloses an air blast atomizer for gas turbine engines, wherein an annular sheet of fuel is subjected to counter-rotating high velocity air flows, which will shear the sheet and form an aerosol of finely atomized fuel particles in air. However, such devices are not suitable for the present application which require a capability for intermittent (pulsed) operation.

U.S. Pat. No. 4,595,143, issued June 17, 1986 to Simmons et al, discloses an air swirl nozzle with a check valve in the fuel supply line to provide a capability for interrupting the supply of fuel. However, such a device is not suitable for supplying fuel to non-premixed charge engines, since it is not possible to interrupt the flow of air. It will be appreciated that the prior art does not provide devices suitable for generating plumes upon which the present system of controlled combustion is based.

OBJECTS OF THE INVENTION

Accordingly, it is the primary object of this invention to provide a pulsed jet generator which is capable of furnishing plumes of appropriate fluid mechanical characteristics intermittently (in the form of repeatedly individually timed single pulses) on demand as required for introducing fuel to the cylinder of a non-premixed charge engine.

A further object of the invention is to provide a jet generator which produces a plume of air containing a fine mist of fuel dispersed in the characteristic whirlpool pattern of a shear layer in turbulent flow.

Yet another object of the invention is to introduce a device employing the principle of air shear, or blast, fuel droplet formation intermittently, which avoids the formation of large droplets at the beginning and end of the plume forming jet injection cycle.

These and other objects of the invention will become apparent upon consideration of the following description of a preferred embodiment of the present pulsed jet generator.

SUMMARY OF THE INVENTION

The present pulsed jet generator comprises concentric annular fuel and air supply lines terminating at a conical seat of a pintle valve where, upon the opening of the valve, pressurized fuel and air streams impinge upon each other at a proper incidence angle to produce atomized fuel particles. The exit orifice of the valve is positioned in the cylinder wall with direct access into the head space of the cylinder of non-premixed charge reciprocating piston internal combustion engine.

One important aspect of the invention comprises control of pressure in the fuel supply line for modulating the supply of fuel independently of the exit orifice closure mechanism, in particular to cut off the fuel supply before the valve is closed to prevent droplet formation, as discussed below. The fuel is connected to high pressure fuel supply reservoir. A preferred approach is to draw the air from the cylinder upon compression by the piston, but before injection of the fuel laden air stream, cooling it by about 300° C., and intensifying its pressure prior to admission to the jet generator. The magnitude of the pressure of the fuel and the air supply and the respective delivery periods are adjusted to provide (1) the appropriate quantity of fuel to be delivered by the injector according to the demand, and (2) an appropriate quantity of carrier air to establish the fluid dynamic conditions necessary for desired plume formation.

By necessity, the amounts of fuel delivered by an individual plume generator are relatively small, and the time period over which injection takes place must be relatively short. It is therefore important to provide a device which will reliably atomize the fuel over the entire injection cycle, i.e., avoid the formation of large droplets at the beginning and end of the cycle. This is accomplished by providing a mechanism which will establish a high velocity shear flow of air before commencing the flow of fuel, and maintaining the high shear air flow until after the appropriate quantity of fuel has been metered out and the fuel flow has been completely shut off.

It is preferred to independently control the exit orifice opening, the fuel supply, and also the air supply, all by electromechanical means, such as solenoid operated valves, in order to permit controlling the entire operation by a microprocessor. The preferred sequence of the valving operation is to (1) pressurize the air in the generator, (2) pressurize the fuel in the generator, (3) open the pintle valve, (4) hold these conditions for the appropriate time interval to meter out the correct quantity of fuel, (5) close the fuel supply, (6) close the pintle valve, and (7) maintain the system in a closed condition until the appropriate instant of time following expansion and compression strokes.

This device permits execution of combustion by means of the desired turbulent plumes of pulsed jets devoid of the drawbacks of the prior art. The device will produce a jet generating a turbulent plume which consists of a sequence of intertwined large scale eddies, constituting a set of whirlpools in the form of more or less distorted vortex ring pattern. Each eddy contains a recirculation core region, where the medium made out of the material of the jet and the air entrained from the surroundings (piston compression heated air) into which the jet is injected, are brought into intimate contact with each other. Created then in the middle of each eddy are best conditions for both heat and mass transfer. Thermal, or auto-ignition takes place naturally in the core region of the eddy, while any flame that may be formed thereupon is wound around so that the process of combustion is executed in its interior. The most important consequence of all this is that the flame is prevented from establishing itself as an envelope around the spray cloud and is thus devoid of most of the pitfalls of a diffusion flame. One has then, in effect, an optimally well mixed reactor to execute the process of combustion under particularly advantageous conditions for chemical processing.

The major objective of the present invention, to provide a generator to create such plumes which will carry fuel in a finely atomized form in an air stream possessing the appropriate fluid dynamic characteristics, is thereby met.

BRIEF DESCRIPTION OF THE DRAWINGS

The nature of the inventive subject matter and its advantages becomes more apparent upon consideration of the following description of the preferred embodiments which are illustrated in the following drawings, in which.

FIG. *2a–f* present an exposed cross-sectional view of the major components of the assembly.

DETAILED DESCRIPTION OF THE PREFERRED EMBODIMENT

Figure 1:
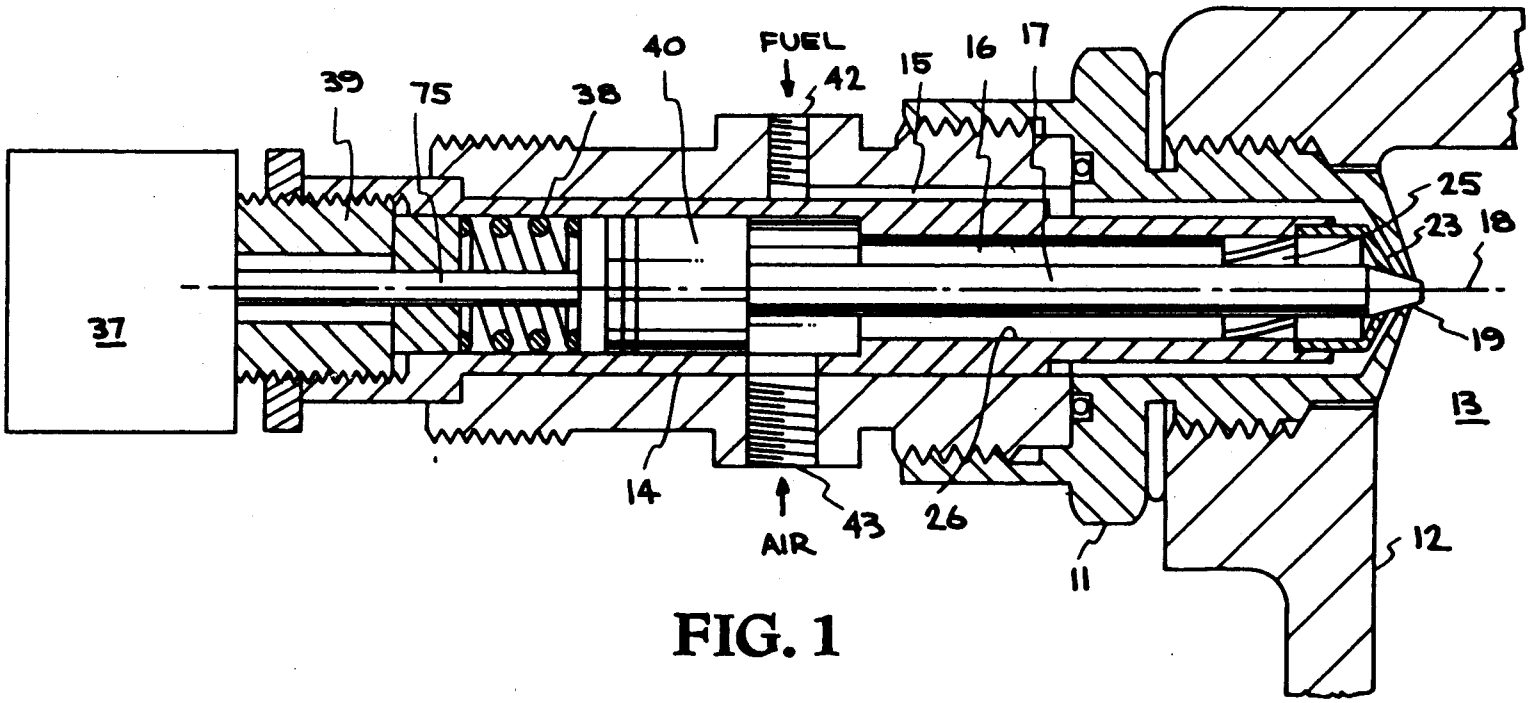
FIG. 1 is a cross-sectional view of a preferred pulsed jet generator assembly.
Figure 2A:
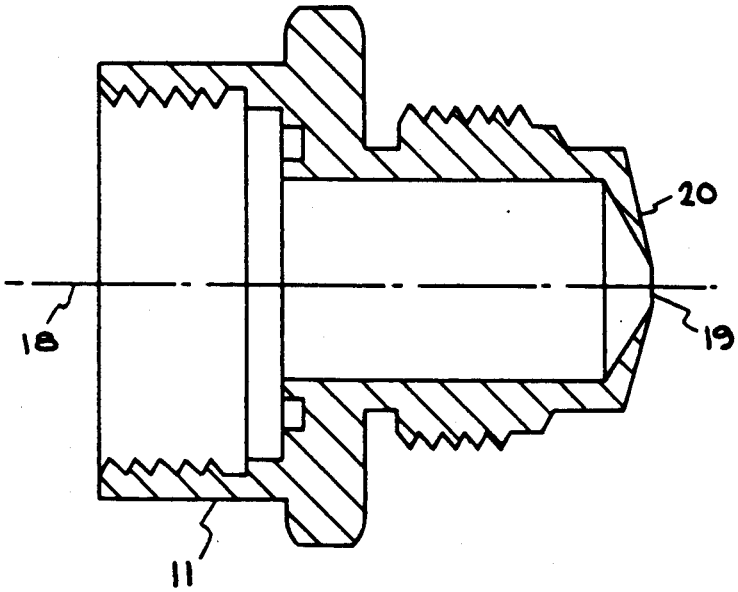
Figure 2C:
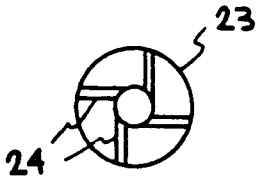
Figure 2D:
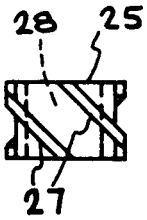
Figure 2B:
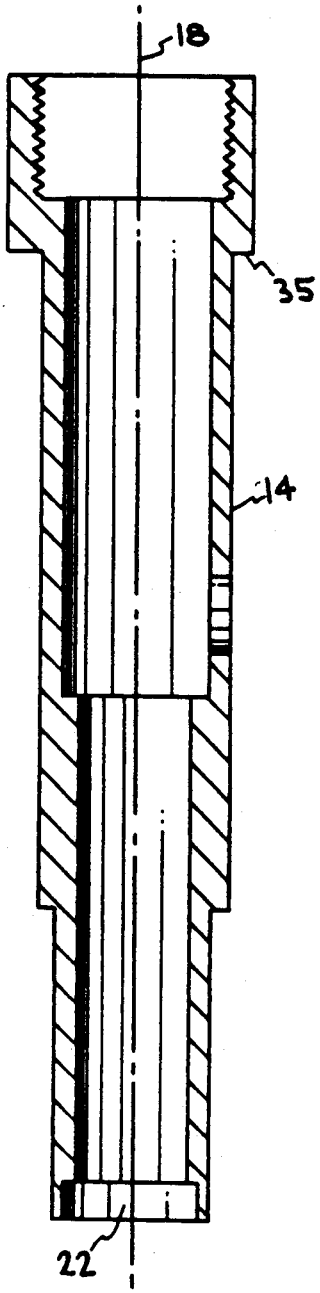
Figure 2E:
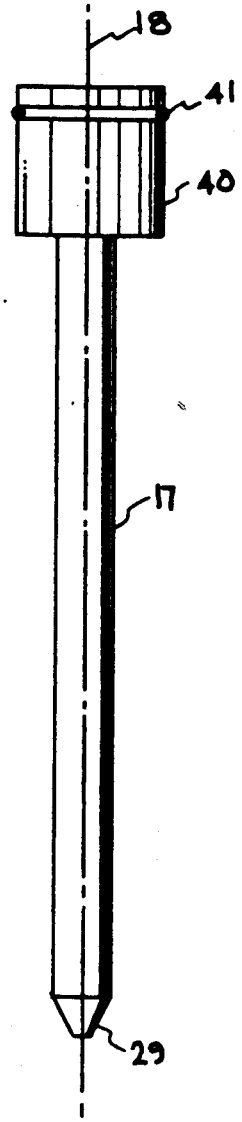
Figure 2F:
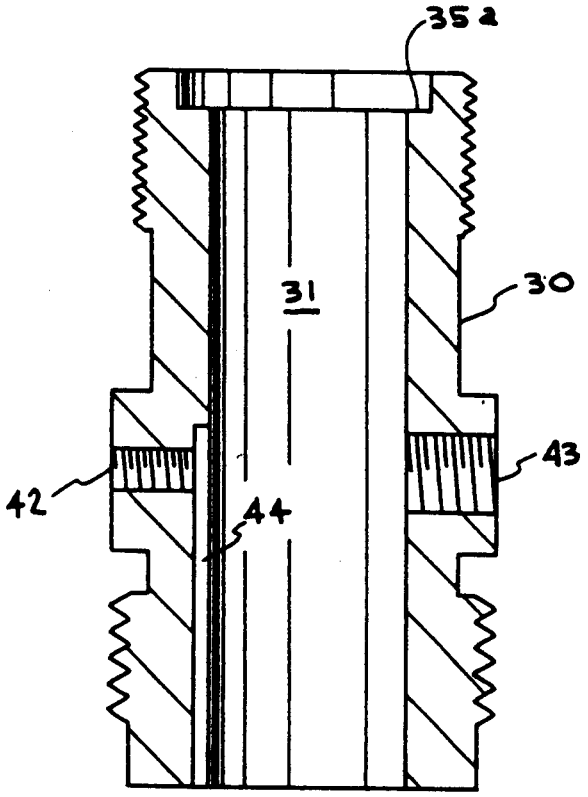

A preferred embodiment of the present pulsed jet plume generator for non-premixed charge engines is shown in FIG. 1, and various details of the individual components of the assembly are shown in FIGS. *2a–f*. With reference to these Figures, outer injector jacket 11 projects through the cylinder wall 12 into the head space 13 of a cylinder of an internal combustion engine. Together with spaced concentric interior tubular barrel 14 the outer jacket defines annular fuel channel 15. The interior of tubular barrel defines an air passageway 16. Pintle 17 is coaxially aligned with the center axis 18 of the nozzle assembly, and serves as a valve for opening and closing exit nozzle 19. The pintle and exit nozzle are appropriately chamfered to provide a leak tight seating arrangement.

The components forming the nozzle are shown in greater detail in FIGS. *2a–c*. FIG. *2a* shows the outer injector jacket 11, which terminates at one end in a conical closure 20, defining at its apex the exit orifice 19. Barrel 14, shown in FIG. *2b*, defines recess 22 at one end thereof to receive fuel channel guide 23, whose view from the bottom is shown in FIG. *2c*. The fuel channel guide exhibits a plurality of conical radial vanes or grooves 24. When seated against the inner surface of the closure 20 of the jacket, the vanes 24 define fuel channels, guiding the flow of fuel from the annular fuel channel 15 toward orifice 19. The vanes are canted to impart the fuel a tangential velocity component to give the fuel a rotational swirl flow characteristic as it enters the exit orifice region.

FIG. *2d* shows air swirl bushing and pintle guide 25. The outer dimensions of the bushing match the dimensions of the central bore 26, so as to permit this bushing to be press fitted into the end of the bore. The bushing is gear cut at an angle to provide air vanes 27 which will impart to the air flow a rotational component opposite to, or in the same sense as (depending on the amount of shear required for best atomization), the rotation of the fuel flow. Bore 28, through the center of the bushing, is dimensioned to guide pintle 17, shown in detail in FIG. *2e*, as it axially reciprocates to intermittently seat its conical tip 29 against the seat surface of the exit orifice.

In operation then, when pressurized fuel and air are supplied to their respective passages, the fuel exits through fuel channel guide 23, is directed towards the center axis in the orifice region, meets a swirling stream of high pressure air, which flows generally orthogonally with respect to fuel leaving the fuel channel guide 23. The action of the high pressure air shears the fuel stream, and forms essentially a fuel aerosol. The pintle, alternately seated and withdrawn, permits an intermittent jet of aerosol (fuel droplets carried by airstream) to be injected into the head space according to the timing of the pintle actuation.

The central mechanical component, injector body 30 is shown in detail in cross section in FIG. *2f*. It's longitudinal bore 31 firmly houses barrel 14 accommodating pintle 17 and holds these in axial alignment. The bottom end of the body 30 is threaded and engaged in jacket 11. Barrel 14 projects through the entire length of bore 31. Upper circular flange 35 fits into a corresponding recess **35*a*** in the upper end of the injector body and is appropriately sealed to prevent leakage of fuel through the upper end of the injector body.

The pintle is reciprocally operated by means of an adjustable stroke solenoid or a solenoid operated pneumatic mechanism 37, per se known in the art, working against injector-spring 38 which normally holds the pintle in the closed position. The spring tension is adjusted by means of threaded boss and lock nut arrangement 39.

Pintle 17 exhibits piston 40 at its upper end, which closely fits the interior diameter of the upper end of bore 31, in order to seal off air passageway 16 at the upper end of the injector body. The seal may be enhanced by providing O-ring 41. In order to reduce the inertia of the pintle, it is preferably made from lightweight materials or is of a hollow construction.

The injector body 30 exhibits laterally bored channels 42 and 43, communicating with the annular fuel supply channel 15 through milled slot 44 in the injector body 30 and the air passageway 16 respectively. The supply of fuel is preferably governed by microprocessor operable 3-way solenoid valve in the fuel supply circuit, preferably mounted to the injector body 30, by being threaded into the lateral fuel channel 42. This valve alternately connects the high pressure fuel supply line to the injector or to a fuel dump, on appropriately timed commands.

Figure 3:
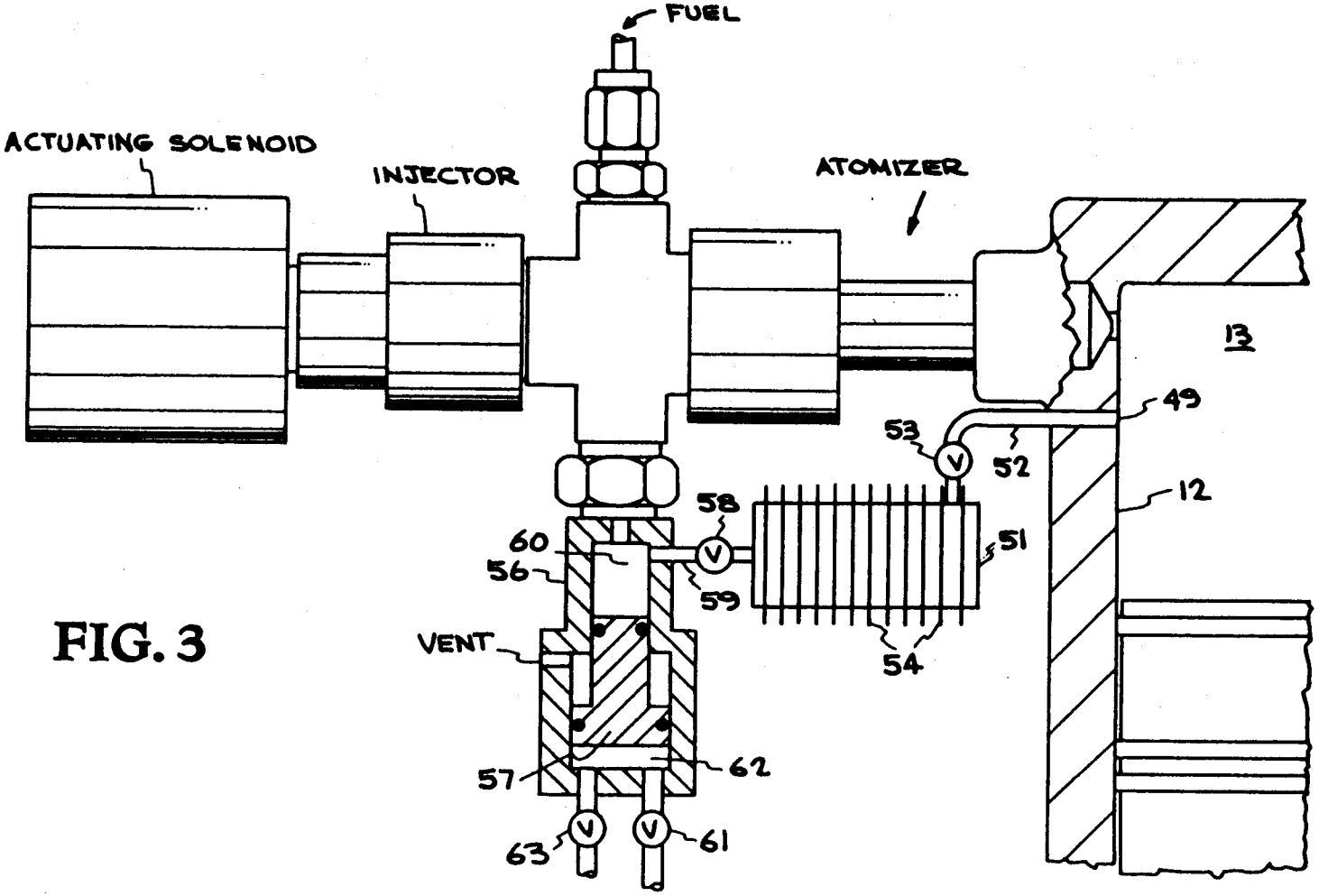
FIG. 3 is a schematic view of a preferred sub-system for supplying air of appropriate quantity and pressure to the pulsed jet combustion generator.
Figure 4A:
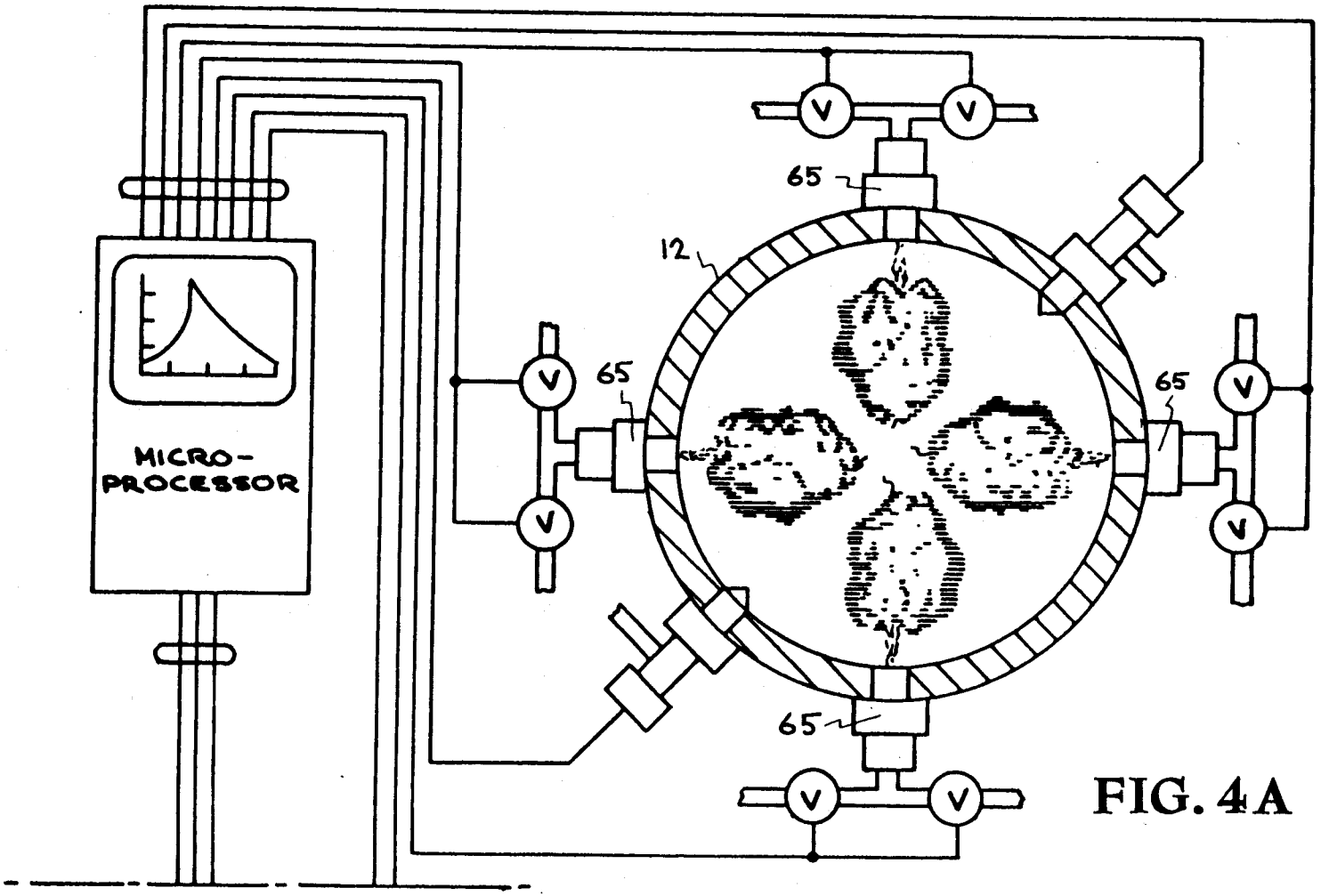
Figure 4B:
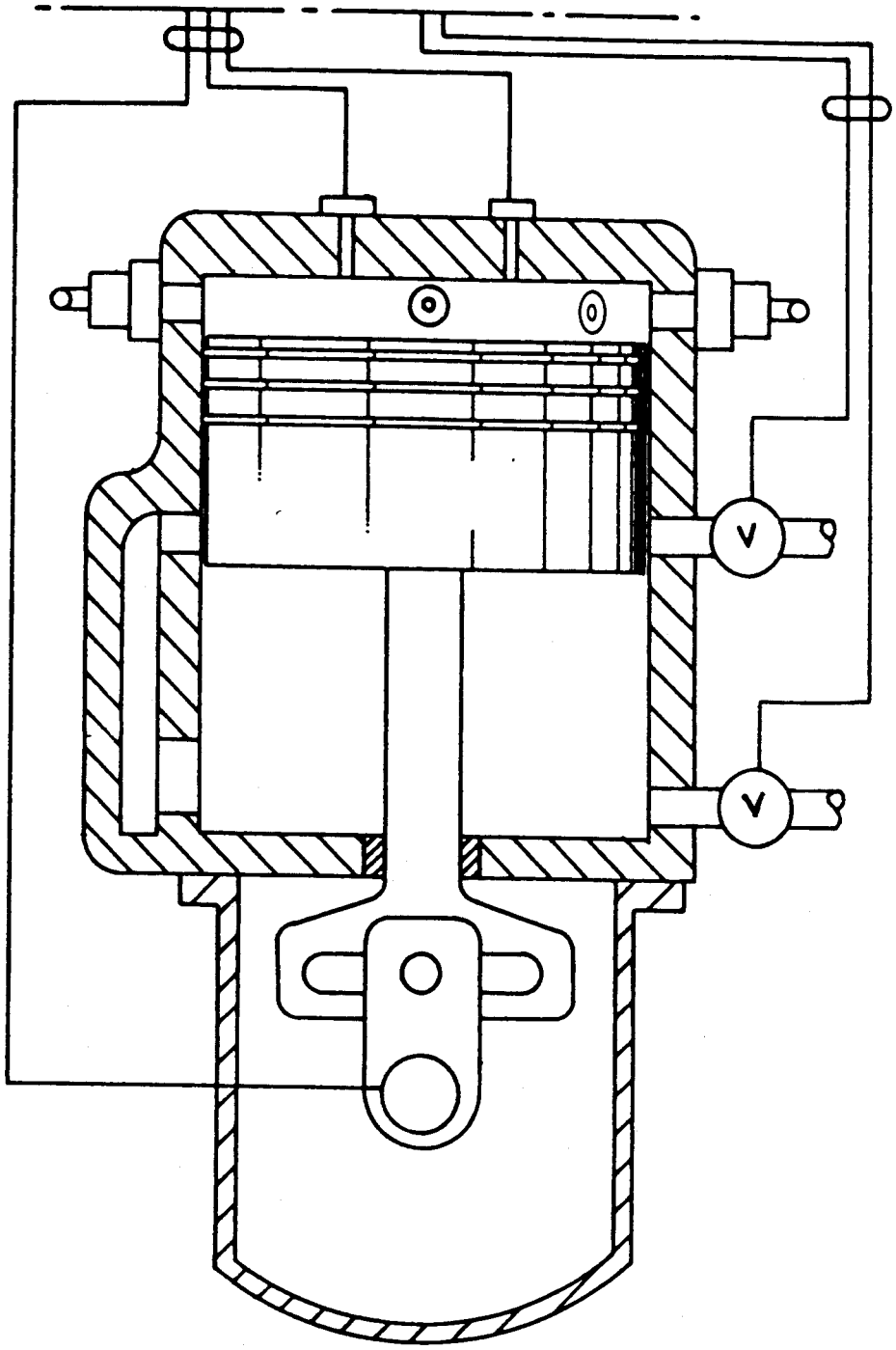

FIG. 3 shows a preferred source of pressurized air. This device draws air from the piston compressed air in the cylinder of a non-premixed charge engine itself, through access hole 49 drilled through the cylinder wall 12 into head space 13 at a predetermined distance below TDC (top dead center). The air is fed to an air reservoir 51 through pressure tubing 52, having a check valve 53 which prevents the air to flow back into the cylinder. In the reservoir the individual pressure pulses accumulate until the ambient pressure reaches a value which corresponds to the pressure of the piston compressed air in the cylinder at the time the piston closes the access hole. Because it is desirable to form a jet and plume whose temperature is below that of the piston compression heated air in the head space of the cylinder, the air in reservoir 51 is cooled, such as by means of coolant-carrying coil or cooling fins 54. In order to impart the air with the necessary increase in pressure for proper jet formation, pressure intensifier 55 is provided, comprising housing 56 and compound piston 57 suitably outfitted with appropriate seals. Computer operated pintle valve 58 in pressure line 59 is used to meter out the desired quantity of air for jet formation into volume 60 defined by housing 55. Piston 57 is actuated by opening valve 61 to admit into intensifier activator volume 62 high pressure fluid from a suitable source (not shown). This source may be hydraulic or pneumatic, and may be the oil pump, the high pressure air source, or the like. Piston 57 thus compresses the air in volume 60 to furnish the high pressure carrier gas stream required by the jet plume generator. Valve 63 is then opened to permit the pressure in volume 62 to return to ambient and volume 60 to be recharged for the next cycle.

While the above description relates principally to our preferred embodiments of the invention, it will be obvious to those skilled in the art that modifications may be made without departing from the spirit and scope of the invention, and that the scope of the invention should therefore be limited only by the following claims.

What is claimed is:

1. A device for introducing atomized fuel into the head space of a cylinder of a non-premixed charge engine for controlled ignition and combustion of the fuel by compression heated air, which comprises:

means for generating and intermittently injecting into said head space during a time interval at the end of the compression stroke of said engine, a stream of air at a velocity and volume productive of a plume in said compression heated air, whose fluid dynamic structure causes entrainment and mixing of said compression heated air in the interior of said plume:

means for introducing liquid fuel into said stream of air so that it is sheared into fine droplets and carried by said stream of air into said head space; to thereby react with said compression heated air in the interior of said plume and causing said plume to expand to fill a part of the volume of said head space.

2. The device of claim 1 wherein said gaseous medium comprises air at a temperature below that of the piston-compressed air into which it is injected.

3. The device of claim 2 wherein the air is cooled by about 300° C.

4. The device of claim 1, wherein said stream of gaseous medium is swirling, and said liquid fuel is introduced into said stream in a counter-swirling direction.

5. The device of claim 4, wherein said stream of gaseous medium and said liquid fuel flow in substantially orthogonal directions within the orifice region of said nozzle.

6. The device of claim 1, further defined, in that it comprises pintle valve means for intermittently opening and closing the orifice of said device with respect to said head space.

7. The device of claim 6, which includes electromechanical means for actuating the opening and closing of said pintle in response to timed microprocessor electrical commands.

8. The device of claim 7, wherein said electromechanical means is a solenoid actuator.

9. The device of claim 1, including means for independently actuating said means for introducing said liquid fuel into said gaseous medium to permit limiting the supply of fuel supply time to periods when both the pintle valve is open and the air supply is turned on to prevent the formation of large droplets.

10. The device of claim 9, wherein said means for independently actuating said means for introducing said liquid fuel comprises a three-way solenoid valve capable of switching the supply of fuel between a fuel dump and said device for introducing said fuel into said gas stream, in response to timed electronic signals issued by a microprocessor.

11. The device of claim 10, wherein said means for generating said stream of said medium comprises means for withdrawing compression heated air from said cylinder, means for cooling said air, to a temperature below the final temperature of said compression heated air in the head space of said cylinder, and means for intensifying the pressure of said air to a pressure sufficient to cause the formation of a jet productive of said plumes.

12. The device of claim 11, further defined in that said means for intensifying the pressure of said air comprises a piston apparatus capable of being hydraulically actuated.

13. The device of claim 12, wherein said piston apparatus is pneumatically actuated by engine oil pressure.

14. The device of claim 12, including electromechanical valve means for actuating said piston apparatus in response to timed microprocessor issued electrical signals.

15. The device of claim 1, including means for introducing into said fuel metered quantities of fuel additives for modulating combustion reaction.

16. The device of claim 5, wherein said fuel additives are compounds capable of accelerating combustion.

17. The device of claim 16, wherein said fuel additives are compounds capable of decelerating combustion reactions.

* * * * *